US008535004B2

(12) United States Patent
Campbell

(10) Patent No.: US 8,535,004 B2
(45) Date of Patent: Sep. 17, 2013

(54) FOUR-WALL TURBINE AIRFOIL WITH THERMAL STRAIN CONTROL FOR REDUCED CYCLE FATIGUE

(75) Inventor: Christian X. Campbell, Oviedo, FL (US)

(73) Assignee: Siemens Energy, Inc., Orlando, FL (US)

( * ) Notice: Subject to any disclaimer, the term of this patent is extended or adjusted under 35 U.S.C. 154(b) by 778 days.

(21) Appl. No.: 12/732,386

(22) Filed: Mar. 26, 2010

(65) Prior Publication Data

US 2011/0236221 A1 Sep. 29, 2011

(51) Int. Cl.
*F01D 5/08* (2006.01)
*F01D 5/18* (2006.01)

(52) U.S. Cl.
USPC ..... 416/97 R; 416/97 A; 416/96 A; 415/115; 415/116

(58) Field of Classification Search
USPC ..... 415/115, 116; 416/97 R, 97 A, 96 A, 416/96 R
See application file for complete search history.

(56) References Cited

U.S. PATENT DOCUMENTS

| | | | | |
|---|---|---|---|---|
| 3,698,834 | A | 10/1972 | Meginnis | |
| 4,768,700 | A * | 9/1988 | Chen | 228/159 |
| 5,392,515 | A * | 2/1995 | Auxier et al. | 29/889.721 |
| 5,405,242 | A * | 4/1995 | Auxier et al. | 415/115 |
| 5,702,232 | A | 12/1997 | Moore | |
| 5,931,638 | A | 8/1999 | Krause et al. | |
| 6,183,192 | B1 | 2/2001 | Tressler et al. | |
| 6,264,428 | B1 * | 7/2001 | Dailey et al. | 416/97 R |
| 6,582,194 | B1 | 6/2003 | Birkner et al. | |
| 6,705,836 | B2 | 3/2004 | Bourriaud et al. | |
| 6,955,523 | B2 | 10/2005 | McClelland | |
| 6,974,308 | B2 * | 12/2005 | Halfmann et al. | 416/97 R |
| 7,303,376 | B2 | 12/2007 | Liang | |
| 7,377,746 | B2 | 5/2008 | Brassfield et al. | |
| 7,488,156 | B2 | 2/2009 | Liang | |
| 7,527,475 | B1 * | 5/2009 | Liang | 416/97 R |
| 7,563,072 | B1 | 7/2009 | Liang | |
| 7,568,887 | B1 | 8/2009 | Liang | |
| 7,819,629 | B2 * | 10/2010 | Liang | 416/97 R |
| 7,866,948 | B1 * | 1/2011 | Liang | 416/97 R |
| 8,047,790 | B1 * | 11/2011 | Liang | 416/97 R |
| 2005/0025623 | A1 * | 2/2005 | Botrel et al. | 416/97 R |

* cited by examiner

*Primary Examiner* — Igor Kershteyn

(57) ABSTRACT

A turbine airfoil (20B) with a thermal expansion control mechanism that increases the airfoil camber (60, 61) under operational heating. The airfoil has four-wall geometry, including pressure side outer and inner walls (26, 28B), and suction side outer and inner walls (32, 34B). It has near-wall cooling channels (31F, 31A, 33F, 33A) between the outer and inner walls. A cooling fluid flow pattern (50C, 50W, 50H) in the airfoil causes the pressure side inner wall (28B) to increase in curvature under operational heating. The pressure side inner wall (28B) is thicker than walls (26, 34B) that oppose it in camber deformation, so it dominates them in collaboration with the suction side outer wall (32), and the airfoil camber increases. This reduces and relocates a maximum stress area (47) from the suction side outer wall (32) to the suction side inner wall (34B, 72) and the pressure side outer wall (26).

20 Claims, 4 Drawing Sheets

FOUR-WALL TURBINE AIRFOIL WITH THERMAL STRAIN CONTROL FOR REDUCED CYCLE FATIGUE

STATEMENT REGARDING FEDERALLY SPONSORED DEVELOPMENT

Development for this invention was supported in part by Contract No. DE-FC26-05NT42644, awarded by the United States Department of Energy. Accordingly, the United States Government may have certain rights in this invention.

FIELD OF THE INVENTION

This invention is related generally to turbine airfoils, and more particularly to hollow turbine airfoils such as blades and vanes with internal cooling channels for passing fluids such as air to cool the airfoils.

BACKGROUND OF THE INVENTION

Gas turbine engines include a compressor for compressing air, a combustor for mixing the compressed air with fuel and igniting the mixture, and a turbine blade and vane assembly for producing power. Combustors operate at high temperatures that may exceed 2,500 degrees Fahrenheit. Typical turbine combustor configurations expose the turbine vane and blade assemblies to these high temperatures. Turbine vanes and blades must be made of materials capable of withstanding such temperatures. Turbine vanes and blades often contain cooling systems for prolonging their life and reducing the likelihood of failure as a result of excessive temperatures.

A turbine blade is a rotating airfoil attached to a disk on the turbine rotor by a platform and blade shank. A turbine vane is a stationary airfoil that is radially oriented with respect to a rotation axis of the turbine rotor. The vanes direct the combustion gas flow optimally against the blades. One or each end of a vane airfoil is coupled to a platform, also known as an endwall. A radially outer vane platform is connected to a retention ring on the engine casing. An inner vane platform, if present, is supported by the vane.

Blades and vanes often contain cooling circuits forming a cooling system. The cooling circuits receive a cooling fluid such as air bled from the compressor of the turbine engine via a plenum and supply port in one or each platform. The cooling circuits often include multiple flow paths inside the airfoil designed to maintain all portions of the airfoil at a relatively uniform temperature. At least some of the air passing through these cooling circuits may be exhausted through film cooling holes in the leading edge, trailing edge, suction side, and pressure side of the airfoil.

Some turbine airfoils have a dual wall structure formed of inner and outer walls. This is called a 4-wall airfoil construction, since the pressure and suction sides of the airfoil each have two walls. The outer wall is exposed to hotter temperatures, so it is subject to greater thermal expansion, and stress develops at the connection between the inner and outer walls.

It is known that high cooling efficiency can be achieved by near-wall cooling in which cooling air flows in channels between the inner and outer walls of a 4-wall airfoil. However, differential thermal expansion between the hot outer walls and the cooler inner walls can cause Low Cycle Fatigue (LCF) limitations for reasons later described.

BRIEF DESCRIPTION OF THE DRAWINGS

The invention is explained in the following description in view of the drawings that show.

DETAILED DESCRIPTION OF THE INVENTION

The invention reduces and relocates stress on a 4-wall turbine airfoil by controlling the thermal expansion mismatch between the relatively hotter outer walls and the relatively cooler inner walls to reduce low cycle fatigue (LCF) in the airfoil.

Figure 1:
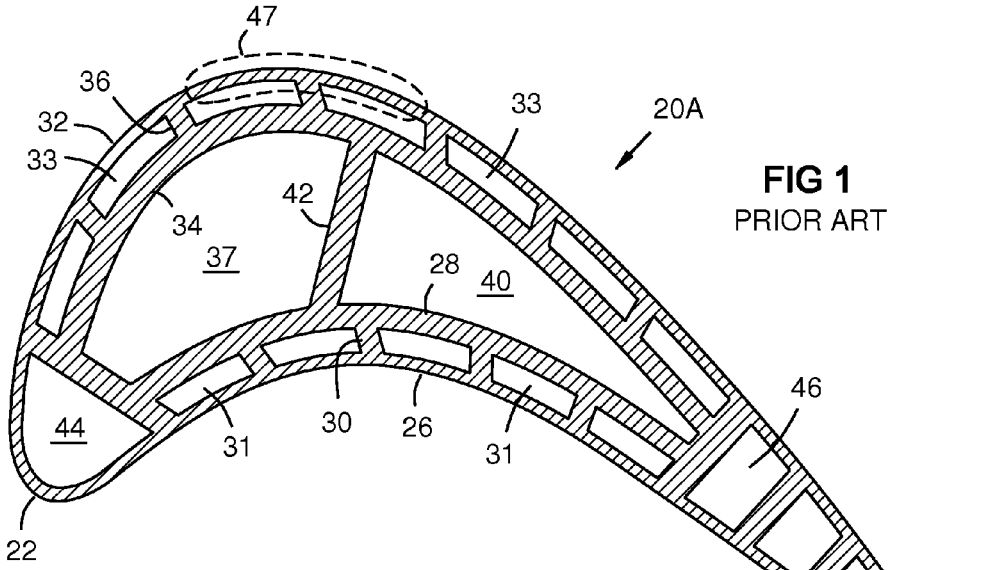
FIG 1 PRIOR ART
FIG. 1 is a sectional view of prior art 4-wall turbine airfoil such as a vane or blade.

FIG. 1 shows a known construction of a 4-wall airfoil 20A. The purpose of a 4-wall airfoil is to provide near-wall cooling, in which the cooling air flows in channels 31, 33 adjacent to the outer walls 26, 32 of the airfoil. The cooling channels 31, 33 are formed between the double walls 26, 28 and 32, 34. Near-wall cooling is advantageous because the cooling air is in close proximity of the hot outer surfaces of the airfoil, and the resulting heat transfer coefficients are high due to the high flow velocity achieved by restricting the flow through narrow channels.

The airfoil 20A of FIG. 1 has a leading edge 22, a trailing edge 24, a pressure side outer wall 26, a pressure side inner wall 28, pressure side ribs 30, pressure side near-wall cooling channels 31, a suction side outer wall 32, a suction side inner wall 34, suction side ribs 36, suction side near-wall cooling channels 33, a central forward plenum 37, a central aft plenum 40, a rib or septum 42 that separates the central plenums, a leading edge cooling channel 44, and one or more trailing edge cooling channels 46. Such designs experience low cycle fatigue especially in the circled area 47. This is because the suction side outer wall 32 thermally expands more than the cooler suction side inner wall 34. This differential expansion tends to increase the camber of the airfoil. However, the pressure side outer wall 26 also thermally expands more than the cooler pressure side inner wall 28. This tends to decrease the airfoil camber, which opposes the forces created by the differential expansion of the suction side walls 32, 34. As a result, the suction side outer wall 32 will tend to bow outward at its apex around area 47, and thus tries to pull away from the connecting ribs 36, creating cyclic stress in that area.

Many different 4-wall airfoil constructions have been evaluated in the past. One hurdle has been manufacturability. However, with advances in metal investment casting and ceramic core processing, this limitation can be overcome. Another problem has been differential thermal growth stress between the hot outer walls 26, 32 and cooler inner walls 28, 34. Previous 4-wall airfoils as in FIG. 1 often use relatively thinner outer walls 26, 32 rigidly attached to relatively thicker inner walls 28, 32 by ribs 30, 36 or pedestals. However, a thin outer wall 26, 32 loses the fight of differential thermal expansion against a thicker inner wall 28, 34, thus creating the type of LCF described above.

Attempts have been made to solve this by either: 1) overcooling the outer wall, or 2) using better wall materials and fabrication technology such as advanced single-crystal casting. These solutions improve the airfoil life by changing the fabrication and additional cooling, but they do not address the design geometry. In contrast, the present invention reduces thermal stress via an airfoil sectional geometry combined with a particular cooling flow pattern, which together control macro deflections in the airfoil due to thermal expansion in a way not previous known in the art.

Figure 2:
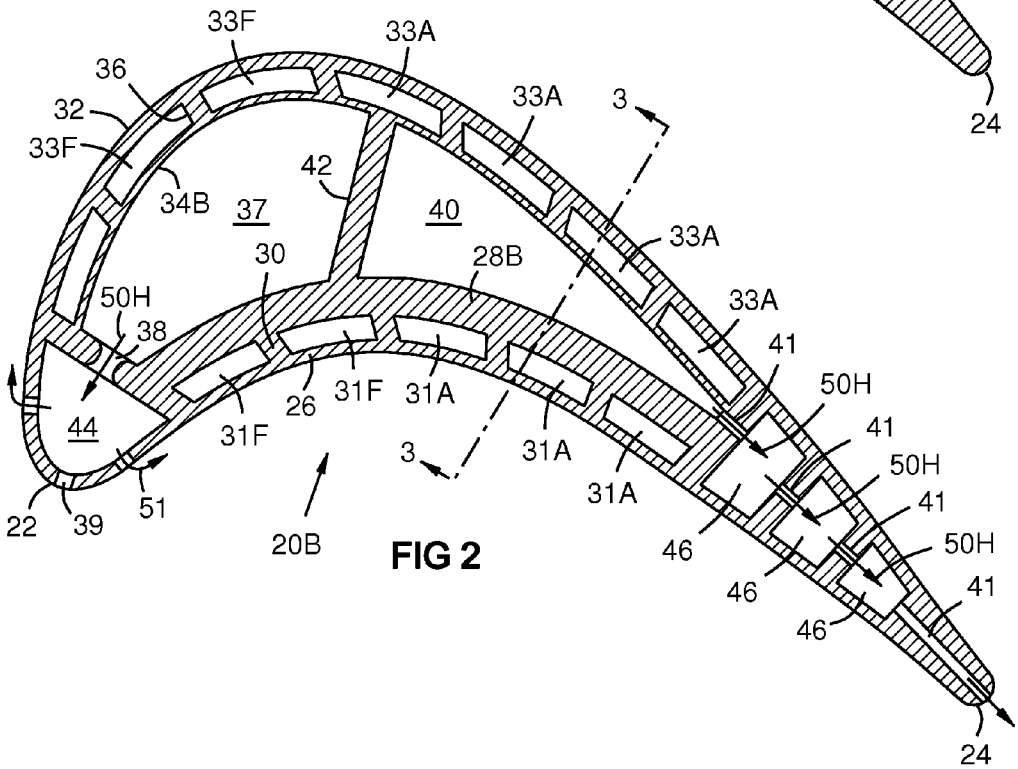
FIG. 2 is a sectional view of a turbine airfoil showing aspects of the invention.

FIG. 2 shows an airfoil section including aspects of the invention. The pressure side inner wall 28B may be at least as thick as the combined thickness of the pressure side outer wall 26 and the suction side inner wall 34. This allows the pressure side inner wall 28B to dominate the other two walls 26, 34B in camber deformation, in cooperation with the suction side outer wall 32. For example, the pressure side inner wall 28B may be at least twice as thick as the pressure side outer wall 26, and at least twice as thick as the suction side inner wall 34B. As another example, the pressure side inner wall 28B may be at least twice as thick as the pressure side outer wall 26, and at least three times as thick as the suction side inner wall 34B. FIG. 2 is not necessarily drawn to scale, however, it is meant to illustrate an embodiment where the pressure side inner wall 28B is at least 30% thicker than the combined thicknesses of the pressure side outer wall 26 and the suction side inner wall 34B to assure its dominance in controlling the camber deflection as the airfoil heats up during operation in a gas turbine.

The near-wall channels are designated as forward pressure-side channels 31F, aft pressure-side channels 31A, forward suction-side channels 33F, and aft suction-side channels 33A. One or more forward passages 38 may transfer cooling air 50H from the forward central plenum 37 to the leading edge cooling channel 44. Film-cooling holes 39 may be provided anywhere on the exterior surface of the airfoil 20B, including ones such as shown passing from the leading edge cooling channel 44 to provide film cooling flows 51 and coolant exhaust. One or more aft coolant passages 41 may communicate from the central aft plenum 40 through the trailing edge 24 as shown.

Figure 3:
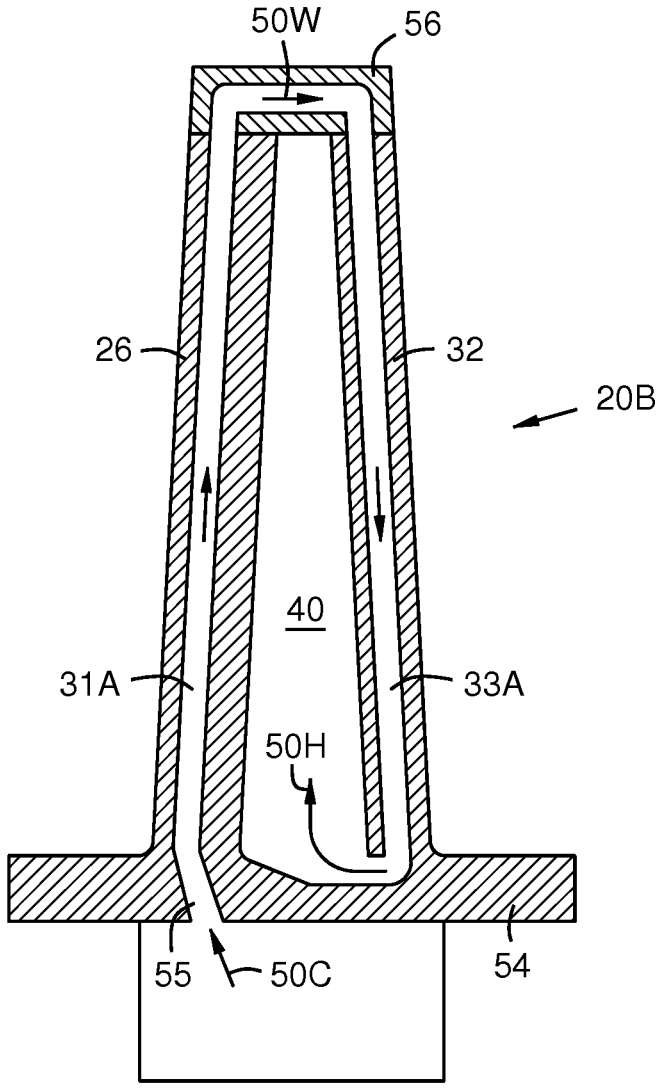
FIG. 3 is a sectional view taken along line 3-3 of FIG. 2.

FIG. 3 illustrates a two-pass radial 4-wall cooling scheme according to aspects of the invention. A cooling fluid such as air in a relatively cool state 50C enters the pressure side near-wall cooling channels 31F, 31A through one or more ports 55 in the platform 54. The coolant travels up the channels 31F, 31A along the pressure side of the airfoil. The coolant turns around in the blade or vane end 56 opposite the inlet port 55, then travels down the respective suction side channels 33F, 33A. Along the way, the cooling fluid gains heat and is illustrated as relatively warmer 50W proximate the vane end 56 and heated cooling fluid 50H as it passes from the suction side near-wall cooling channels 33F, 33A into the respective central plenums 37, 40 of the airfoil. The forward edge near-wall channels 33F are dumped into the leading edge plenum 37, and the trailing edge channels 33A are dumped into the trailing edge plenum 40. This forms a forward cooling circuit 31F-33F-37-44 and an aft cooling circuit 31A-33A-40-46. The aft circuit is shown in FIG. 3. The fore and aft cooling circuits may be independent in some embodiments, with no communication between them, providing independent metering. The coolant 50H in the central plenums 37, 40 respectively cools the leading edge 22 and trailing edge 24 via the leading and trailing edge cooling channels 44, 46 as shown in FIG. 2. The coolant 50C, 50W, 50H heats as it flows within the airfoil 20A from the pressure side 26 to the suction side 32.

The difference in temperature of the cooling air is used to relieve thermal stress in the airfoil by creating an inverse temperature gradient across the pressure side inner wall 28B. In prior art designs, this wall is normally hotter toward the pressure side outer wall 26 and colder toward the central cooling plenums 37, 40. However, in the present flow paths the cooling air 50C is coldest in the pressure side near-wall channels 31F, 31A, and is hotter 50H in the central plenums 37, 40. As a result, the pressure side inner wall 28B is colder toward the pressure side outer wall 26 and hotter toward the central plenums 37, 40, reversing the normal gradient (i.e. inverse gradient). The resulting differential thermal expansion across this wall causes its curvature to increase. A thermal gradient of only about 20° C. (for example 435 to 455° C.) is enough to control the strain state of the airfoil in one embodiment.

FIG. 3 represents either a rotating turbine blade or a stationary vane. Stationary vanes may have a platform 54 at each end of the airfoil not shown. Sometimes a separate cooling flow 50C is supplied to each of these platforms. In this case, the forward cooling circuit 31F, 33F, 37 and the aft cooling circuit 31A, 33A, 40 may optionally start at respective inlet ports 55 in opposite platforms. In each circuit the coolant flow still starts on the pressure side of the airfoil, turns around in the end of the airfoil opposite the inlet port, passes to the suction side, then to the central plenums.

Figure 4:
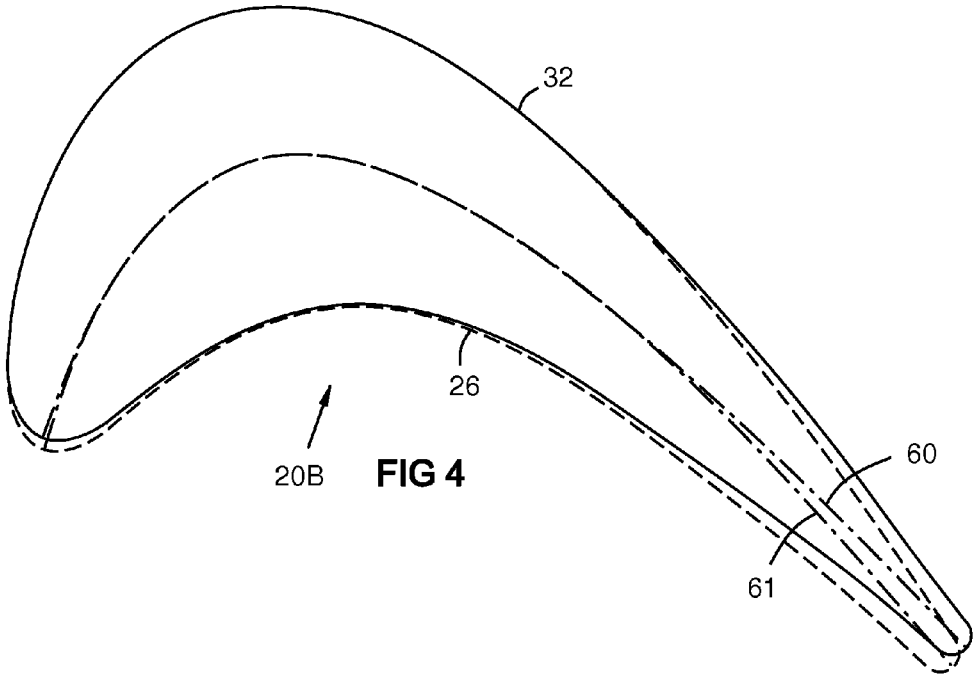
FIG. 4 is an outline of an airfoil in a cold state (solid lines) and under operational heating (dashed lines), also showing a camber of the airfoil in each state.

FIG. 4 shows a comparison of the original cold airfoil shape in solid outline and the deformed hot airfoil shape in dashed outline, with a respective original camber line 60 and deformed camber line 61. The pressure side outer wall 26 increases its curvature in the hot state due to the temperature inversion in the pressure side inner wall previously described. This allows the suction side outer wall 32 to grow naturally thermally with less stress as it increases its curvature also.

The pressure side outer wall 26 also tends to grow and tries to reduce its concavity in the dual-wall geometry. However, the curling of the thicker pressure side inner wall 28B dominates, increasing the concavity of the pressure side outer wall 26. The pressure side outer wall 26 and the suction side inner wall 34 oppose curling 70 of the pressure side inner wall 28B. These opposing walls 26, 34 are made thin enough not to negate the curling effect of the pressure side inner wall and to have some compliance. The pressure side inner wall 28B may be at least as thick as the combined thicknesses of the pressure side outer wall 26 and the suction side inner wall 34B as previously described. Stress states and predicted thermal growth geometries in various airfoil embodiments of the present invention can be calculated with commonly available design tools.

The net effect is that thermal strain is off-loaded from the suction side outer wall 32 onto the pressure side outer wall 26 and the suction side inner wall 34. This is a net advantage for the following reasons:

- Due to the difference in moment arm, the thermal curling effect relieves more strain on suction side than it adds on the pressure side.
- The pressure side inner wall 26 is cooler than the suction side outer wall 32 due to the lower temperature of the cooling air 50C on that side, so it has better LCF properties.
- The suction side outer wall 32 tends to grow away from the airfoil, while the pressure side outer wall 26 tends to grow into the airfoil. This causes tensile stress between the outer wall 32 and ribs 36 on the suction side and compressive stress on the pressure side. Compressive stress is favorable for life. Past problems observed in 4-wall designs were due to cracking on the suction side of the airfoil.

Figure 5:
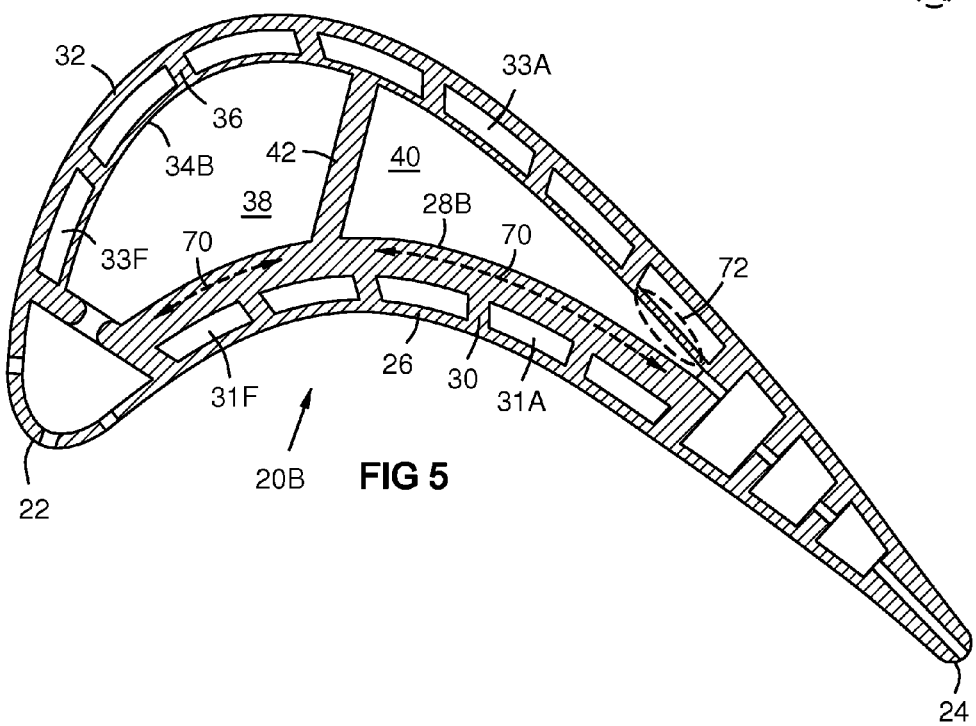
FIG. 5 is a sectional view as in FIG. 2, showing a relocated stress area.

In FIG. 5, the suction side inner wall 34B is stretched by both the thermal growth of the suction side outer wall 32 and the thermal curling 70 of the pressure side inner wall 28B. As a result, this wall 34B may experience the highest thermal strain, for example in area 72. Therefore, it is important that this wall have relatively good compliance. This stress is mitigated by the following:

The suction side inner wall 34B is relatively cool; therefore it has excellent LCF properties.

The suction side inner wall 34B may be thin to provide compliance.

For greater compliance features such as undulations may be added to this wall.

Figure 6:
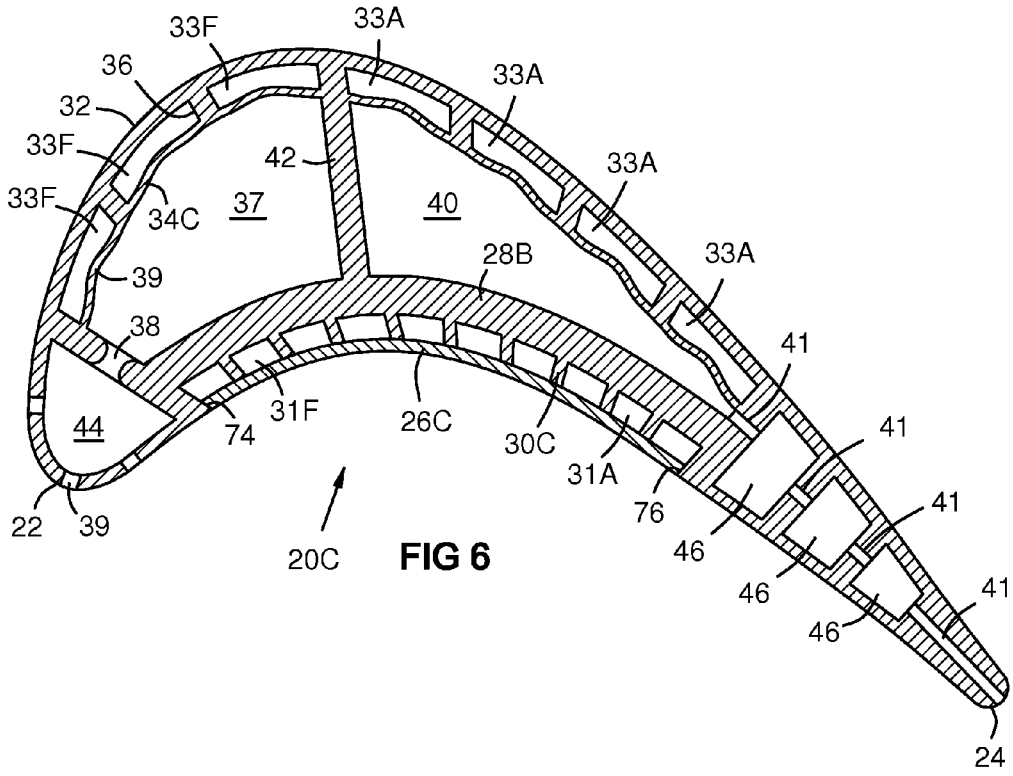
FIG. 6 is a sectional view of a turbine airfoil showing additional embodiments of aspects of the invention.

FIG. 6 illustrates an embodiment 20C having a suction side inner wall 34C with a generally sinusoidal undulation between each rib 36 as a compliance mechanism. This may allow the suction side inner wall 34C to be thicker than otherwise necessary to get the same degree of compliance, and therefore being easier to cast. In view of the mitigation factors above, the illustrated stress area 72 is a more favorable location than stress area 47 of FIG. 1.

FIG. 6 also illustrates a pressure side outer wall 26C that is formed separately from the ribs 30C, and is attached thereto. For example, this wall may be formed by metal spraying onto the ends of the ribs with a fugitive material in the channel areas. The pressure side outer wall 26C has ends bracketed by abutments 74, 76 at the leading and trailing edges of the airfoil. These abutments may converge slightly when the airfoil camber 61 increases. This causes the wall 26C to bow toward the ribs 30C, compressing the bonds between the wall 26C and the ribs 30C. This wall 26C may be made of a metal with a lower elastic modulus than that of the ribs 30C and the pressure side inner wall 28B for increased compliance.

While various embodiments of the present invention have been shown and described herein, it will be obvious that such embodiments are provided by way of example only. Numerous variations, changes and substitutions may be made without departing from the invention herein. For example, the invention has been described as a gas turbine engine airfoil including thermal strain state control arrangement effective to allow the suction side outer wall to increase its curl during operation of the gas turbine engine so that a region of peak strain in the airfoil during operation of the gas turbine engine is located remote from the suction side outer wall. The airfoil may have a thermal expansion control mechanism causing its camber to increase under differential thermal expansion of the airfoil during operational heating in order to improve its LCF life. Herein, camber means the degree of curvature of a line halfway between the pressure side and the suction side of an airfoil section. In one embodiment, the airfoil sectional geometry and an internal cooling flow pattern cause the airfoil camber to increase by controlling a temperature gradient on an internal wall structure of the airfoil. In the embodiments described above, it was the relatively thicker pressure side inner wall that curled and controlled thermal strain to off-load one of the outer walls, but in other embodiments it may be the suction side inner wall that is sized to control thermal strain and to off-load an outer wall. Other embodiments may utilize a temperature difference between the average metal temperature of the pressure side and suction side of the airfoil. This may be accomplished with a difference in the cooling air temperature between the pressure and suction sides of the airfoil. This could also be accomplished by using thermal barrier coatings having different insulating abilities on opposed sides of the airfoil. Alternatively, active heating of the backside of the strain-controlling wall may be used instead of the passive cooling scheme described above. Alternatively, bi-material may be used to achieve a desired thermal curl, for example by spraying a low or high coefficient of thermal expansion (CTE) alloy on only one side of the strain-controlling wall.

Accordingly, it is intended that the invention be limited only by the spirit and scope of the appended claims.

The invention claimed is:

1. An airfoil for a gas turbine engine comprising:

leading and trailing edges interconnected by pressure side and suction side outer walls defining an airfoil shape;

pressure side and suction side inner walls connected to the pressure side and suction side outer walls respectively by a plurality of ribs defining a plurality of respective pressure side and suction side cooling channels there between, said pressure side cooling channels connected to said suction side cooling channels at an end of the airfoil;

a means for off-loading thermal expansion stress during high temperature use of the airfoil in the gas turbine engine from an outer wall of the airfoil onto an inner wall of the airfoil.

2. The airfoil of claim 1, wherein the means for off-loading thermal expansion stress comprises:

the pressure side inner wall being sized relative to the pressure side outer wall and the suction side inner wall such that the pressure side inner wall controls a thermal strain state of the airfoil; and a temperature management scheme which imparts an inverse temperature gradient on the pressure side inner wall.

3. The airfoil of claim 2, wherein the temperature management scheme comprises:

a central cooling chamber defined within the airfoil between the pressure and suction side inner walls; and a coolant routing scheme which directs coolant through the pressure side and suction side cooling channels to the central cooling chamber.

4. The airfoil of claim 2, wherein a thickness of the pressure side inner wall is larger than a sum of thicknesses of the pressure side outer wall and the suction side inner wall.

5. The airfoil of claim 2, wherein a thickness of the pressure side inner wall is at least twice a thickness of the pressure side outer wall and at least twice a thickness the suction side inner wall.

6. The airfoil of claim 2, wherein a thickness of the pressure side inner wall is at least three times a thickness of the suction side inner wall.

7. The airfoil of claim 2, wherein a thickness of the pressure side inner wall is at least 30% larger than a sum of thicknesses of the pressure side outer wall and the suction side inner wall.

8. An airfoil for a gas turbine engine comprising:

leading and trailing edges interconnected by curved pressure side and suction side outer walls defining an airfoil shape;

pressure side and suction side inner walls connected to the pressure side and suction side outer walls respectively by a plurality of ribs defining a plurality of respective pressure side and suction side cooling channels there between;

a thermal strain state control arrangement effective to allow the suction side outer wall to increase its curvature during operation of the gas turbine engine so that a region of peak stress in the airfoil during operation of the gas turbine engine is located remote from the suction side outer wall.

9. The airfoil of claim 8, wherein the thermal strain state control arrangement comprises one of the inner walls being sized so that it controls the thermal strain state of the airfoil.

10. The airfoil of claim 9, wherein the one of the inner walls is the pressure side inner wall, and further comprising a cooling arrangement effective to impart an inverse temperature gradient in the pressure side inner wall during use of the gas turbine engine.

11. The airfoil of claim 10, wherein the cooling arrangement comprises:

a central cooling chamber defined within the airfoil between the pressure and suction side inner walls; and a coolant routing scheme which directs coolant through the pressure side and suction side cooling channels to the central cooling chamber.

12. An airfoil for a gas turbine engine, comprising:

a leading edge;

a trailing edge;

a concave pressure side outer wall spanning between the leading and trailing edges on a pressure side of the airfoil;

a convex suction side outer wall spanning between the leading and trailing edges on a suction side of the airfoil; and a thermal expansion control mechanism that causes a camber of the airfoil to increase due to differential thermal expansion of the airfoil during operational heating, where camber is a degree of curvature of a line midway between the pressure and suction sides of the airfoil.

13. An airfoil as in claim 12, wherein the thermal expansion control mechanism comprises means for controlling a temperature gradient on an internal wall structure of the airfoil to produce the increase in camber during operational heating.

14. An airfoil as in claim 12, wherein the thermal expansion control mechanism comprises a sectional geometry of the airfoil and a cooling fluid flow pattern in the airfoil that together cause the airfoil camber to increase in curvature under operational heating.

15. An airfoil as in claim 14, further comprising a concave pressure side inner wall connected to the pressure side outer wall by a plurality of pressure side ribs defining a plurality of pressure side near-wall cooling channels between the pressure side outer and inner walls;

a convex suction side inner wall substantially equidistant from the suction side outer wall and connected thereto by a plurality of suction side ribs;

a plurality of suction side near-wall cooling channels between the suction side outer and inner walls; and at least one central cooling plenum in the airfoil;

wherein the pressure side inner wall is at least twice as thick as the suction side inner wall.

16. An airfoil as in claim 15, comprising:

a central forward cooling plenum;

a central aft cooling plenum;

a leading edge cooling channel in fluid communication with the central forward cooling plenum;

film cooling holes passing though the leading edge of the airfoil from the leading edge cooling channel;

a trailing edge cooling channel in fluid communication with the central aft cooling plenum;

cooling exit holes passing though the trailing edge of the airfoil from the trailing edge cooling channel;

at least one fluid flow path from an inlet port at a first end of the airfoil into the pressure side near-wall cooling channels, then crossing over a second end of the airfoil to the suction side near-wall cooling channels, then passing into the central cooling plenums, then passing into the leading and trailing edge cooling channels.

17. An airfoil as in claim 15, comprising:

a first fluid flow path from a forward subset of the pressure side near-wall cooling channels, crossing over the second end of the airfoil to a forward subset of the suction side near-wall cooling channels, then passing to the central forward cooling plenum at the first end of the airfoil, then passing to the leading edge cooling channel; and a second fluid flow path from an aft subset of the pressure side near-wall cooling channels, crossing over the second end of the airfoil to an aft subset of the suction side near-wall cooling channels, then passing to the central aft cooling plenum at the first end of the airfoil, then passing to the trailing edge cooling channel;

wherein a cooling fluid passes through the pressure side near-wall cooling channels, then through the suction side near-wall cooling channels, then through the central plenums, then to the leading and trailing edge cooling channels, then exits the airfoil through the film cooling holes and trailing edge cooling exit holes.

18. An airfoil as in claim 15, wherein the pressure side inner wall is at least 30% thicker than a combined thickness of the suction side inner wall and the pressure side outer wall.

19. An airfoil as in claim 15, wherein the suction side inner wall comprises a generally sinusoidal undulation between each of the suction side ribs.

20. An airfoil as in claim 15, wherein the pressure side outer wall comprises at least a portion formed of a material with a lower elastic modulus than an elastic modulus of the pressure side inner wall and the pressure side ribs, and said portion is attached to the pressure side ribs and comprises ends that are bracketed between abutments at the leading edge and the trailing edge of the airfoil.

* * * * *